US005088895A

United States Patent [19]

Webb

[11] Patent Number: 5,088,895

[45] Date of Patent: Feb. 18, 1992

[54] VACUUM PUMPING APPARATUS

[75] Inventor: Paul D. Webb, Tioga, Pa.

[73] Assignee: The Hilliard Corporation, Elmira, N.Y.

[21] Appl. No.: 577,400

[22] Filed: Sep. 4, 1990

[51] Int. Cl.[5] ..... F04B 19/24

[52] U.S. Cl. ..... 417/53

[58] Field of Search ..... 417/53, 48; 137/571

[56] References Cited

U.S. PATENT DOCUMENTS

| | | | |
|---|---|---|---|
| 3,797,516 | 3/1974 | Forster et al. | 137/340 |
| 4,504,194 | 3/1985 | Holden | 417/48 |
| 4,725,204 | 2/1988 | Powell | 417/205 |

OTHER PUBLICATIONS

*The Encyclopedia of Physics*, Second Edition, pp. 976-979.

*Perry's Chemical Engineers' Handbook*, Sixth Edition, pp. 6-32 to 6-37.

*Marks' Standard Handbook for Mechanical Engineers*, Eighth Edition, pp. 14-44 to 14-48.

*Primary Examiner*—Richard A. Bertsch

*Assistant Examiner*—Charles G. Freay

*Attorney, Agent, or Firm*—Seidel, Gonda, Lavorgna & Monaco

[57] ABSTRACT

Method and apparatus for achieving a high degree of vacuum pumping in an enclosure utilizing a single-stage pump. A vacuum pumping unit is coupled to a plurality of interconnected enclosures through a series of valves. When evacuation of a selected enclosure is desired, the valves are opened sequentially for a brief duration such that the enclosures are alternatively evacuated to the atmosphere and to other partially evacuated enclosures.

11 Claims, 1 Drawing Sheet

VACUUM PUMPING APPARATUS

FIELD OF INVENTION

The present invention relates to a method and apparatus for achieving a high degree of vacuum in an enclosure without the need for expensive and complex vacuum pumping systems. A single-stage vacuum pump is coupled to a plurality of interconnected enclosures through an arrangement of valves. When evacuation of a selected enclosure is desired, the valves are opened sequentially for a brief duration such that the enclosures are alternatively evacuated to the atmosphere and to other partially evacuated enclosures.

BACKGROUND OF THE INVENTION

This invention relates to a method and apparatus for producing a high degree of vacuum ($10^{-3}$ torr to $10^{-7}$ torr and even higher vacuums) utilizing only single-stage pumps. Currently, physical limitations of single-stage pumps preclude them from efficiently evacuating an enclosure to an internal pressure below approximately $10^{-2}$ torr. See, "Vacuum Techniques", *Encyclopedia of Physics,* 2d Ed., pp. 976.

Some methods available to achieve a high degree of vacuum utilize multi-stage pumps, cryopumps, turbomolecular pumps, rotary pumps with oil seals, and diffusion pumps (oil and mercury vapor). Cryopumps consist of one or more exposed surfaces refrigerated to a temperature usually below 100° K., at which certain gases will be condensed and form a layer having an equilibrium vapor pressure below a specified limit. A diffusion pump utilizes one or more jets of vapor into which molecules from the chamber can diffuse and be carried forward into a region of higher pressure. Mercury vapor pumps require efficient refrigerated traps to keep mercury vapor out of the chamber being evacuated. Oil vapor jet pumps, while able to achieve high vacuum levels, cannot discharge directly to the atmosphere because of limitations on the vapor pressure which can be generated. See, "High Vacuum Pumps" by B. B. Dayton, *Standard Handbook for Mechanical Engineers,* 1978, pp 14-44–14-48 and "Vacuum Systems", *Perry's Chemical Engineers' Handbook,* 6th Ed., 1984, pp. 6-32–6-37. Single-stage pumps offer the advantages of fewer moving parts and seals, lower energy requirements, and lower attendant maintenance costs than the more-complicated systems currently available for achieving high vacuums.

Another approach has been to couple an airlock to an expansion tank having a volume larger than the airlock. Such a system is disclosed in U.S. Pat. No. 4,283,631. One of the difficulties in achieving a high degree of vacuum in the system disclosed in that patent is that the expansion tank is evacuated to the atmosphere. Conventionally, a single-stage pump evacuating a system to the atmosphere has a limited ability to evacuate enclosures below a vacuum of about $10^{-2}$ torr. Since the expansion tank disclosed in U.S. Pat. No. 4,283,631 is constantly evacuated to the atmosphere, the ultimate vacuum level of the airlock is dictated by the volume of the expansion tank. In order to get progressively higher vacuum levels in the airlock, the volume of the expansion tank must be increased proportionally. Accordingly, a single-stage pump would be impractical for evacuating the expansion tank and airlock to a sufficiently high degree.

It is an object of this invention to overcome these limitations inherent in vacuum pumping systems.

It is another object of the invention to provide a vacuum pumping system that achieves a high degree of vacuum using only a single-stage pump.

SUMMARY OF THE INVENTION

According to the present invention, these and other objects and advantages are achieved in the apparatus for vacuum pumping a selected enclosure utilizing a single-stage pump. The apparatus comprises a plurality of enclosures coupled to a manifold having a plurality of inlets and a common outlet. Each inlet to the manifold is connected to one of the plurality of enclosures. A vacuum pump is connected to the manifold outlet for drawing a vacuum thereon. Valves are located in the inlets to the manifold for selectably interconnecting the plurality of enclosures and for selectably connecting at least one of the tanks to the vacuum pump. The exhaust of the vacuum pump is selectably connected to at least one of the plurality of enclosures and to atmosphere. The invention allows an enclosure to be evacuated to a high degree of vacuum utilizing only a single-stage pump.

BRIEF DESCRIPTION OF THE DRAWING

For the purpose of illustrating the invention, there is shown in the drawing a form which is presently preferred; it being understood, however, that this invention is not limited to the precise arrangements and instrumentalities shown.

The single figure is a simplified diagram of the vacuum pumping apparatus of the present invention.

DETAILED DESCRIPTION OF THE INVENTION

Figure 1:
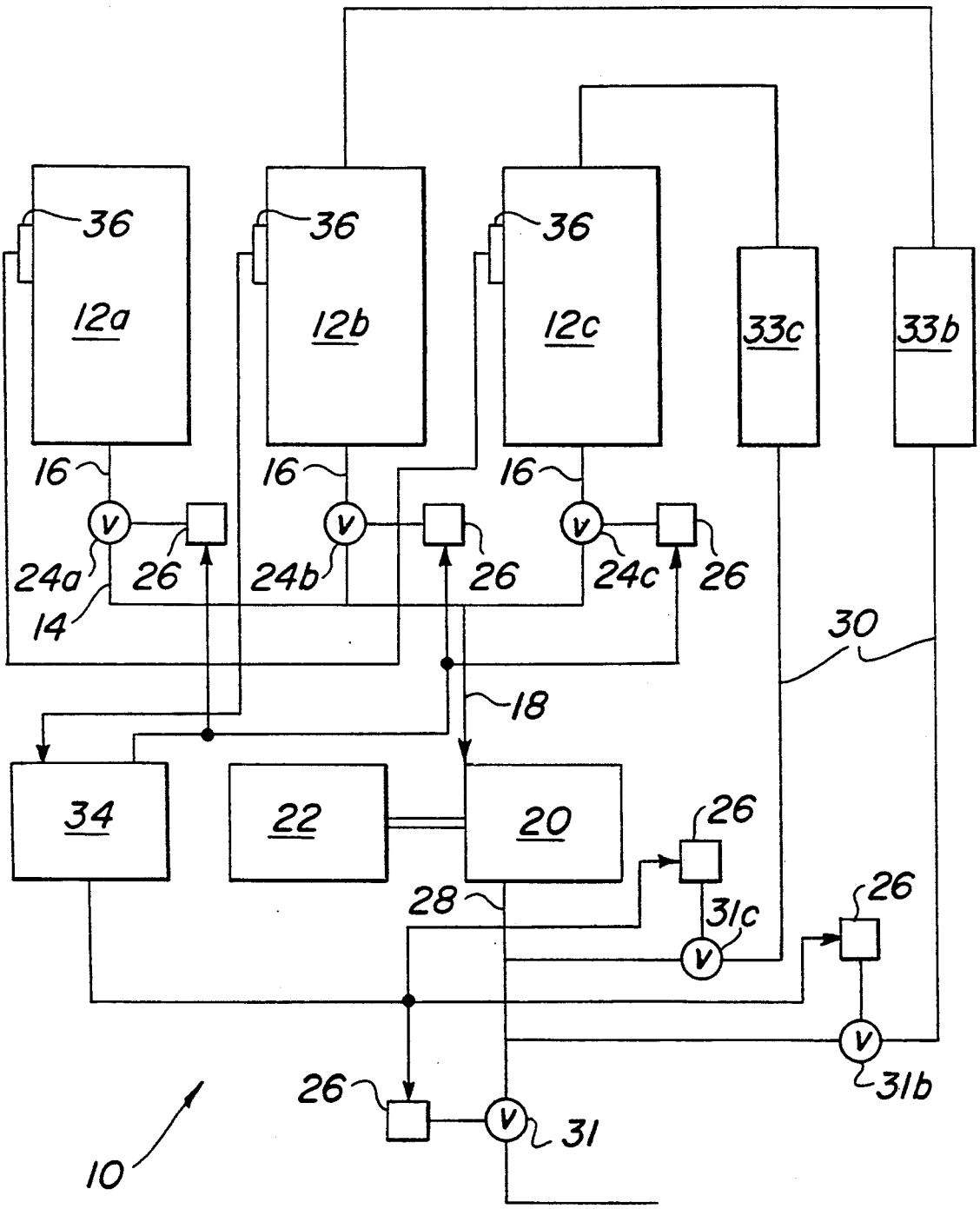

The preferred embodiment of the vacuum pumping apparatus of the present invention is illustrated in the figure. The apparatus, generally designated 10, includes a plurality of enclosures 12 connected to a manifold 14 through individual conduits 16. The preferred apparatus, illustrated in the figure, utilizes three enclosures 12, designate 12*a*, 12*b* and 12*c*. However, the number of enclosures 12 is not limited to this number. Depending upon the degree of vacuum desired, and other system requirements, the number of enclosures 12 may be decreased to as few as two or increased to any number. An outlet 18 connects the manifold 14 to a vacuum pump 20. Vacuum pump 20 is a conventional single-stage pump driven by motor 22. A vacuum valve 24, which may, but need not, be an air-operated butterfly valve controlled by a solenoid 26, is located in each conduit 16. In the figure, three such conduits 16*a*, 16*b* and 16*c* and three such valves 24*a*, 24*b* and 24*c* are illustrated, corresponding to the three enclosures 12. The valves 24 selectably interconnect the plurality of enclosures 12 to each other and to vacuum pump 20 through manifold 14. The outlet of the vacuum pump 20 is coupled via conduit 28 to means 30 for selectably interconnecting the vacuum pump 20 to at least one of the plurality of enclosures 12 and to the atmosphere.

In the preferred embodiment, two of the enclosures 12 are separately connected to the conduit 28 at the outlet of the vacuum pump 20 via means 30. As illustrated in FIG. 1, means 30 separately connects the conduit 28 to enclosures 12*b* and 12*c*. The means 30 includes vacuum valves 31 and may include coolers 33 to increase the efficiency, as known in the art, of the pumping apparatus 10. The vacuum valves 31 may, but need not be, air-operated butterfly valves controlled by a solenoid 26, similar to vacuum valves 24.

In the illustrated preferred embodiment, a solenoid 26 is coupled to each of the vacuum valves 24 and vacuum valves 31 to regulate their opening and closing. The solenoids 26 may, but need not, be regulated by a process control device 34 known in the art and which is responsive to input signals and generates control signals as outputs. The input signals to control device 34 in the preferred embodiment are in the form of electrical signals representative of pressure. The input signals may be derived from a mechanical-to-electrical transducer 36 on each enclosure 12*a*, 12*b* and 12*c*, which converts the pressure in the enclosures 12 into an electrical signal.

To initiate operation, vacuum valves 24*a* through 24*c* and 31*a* are opened and vacuum valves 31*b* and 31*c* are closed by the solenoids 26 in response to command signals from controller 34. Motor 22 is then energized, and all of the enclosures 12 are initially partially evacuated through the vacuum pump unit 20 to the atmosphere through valve 31*a*, to a pressure of approximately $10^{-2}$ torr or lower. This initial pressure is a function of the characteristics of the vacuum pump 20 and the enclosures 12, and the exact pressure is not crucial to the invention.

When the initial pressure is achieved in the enclosures 12, as indicated by transducers 36, the process control device 34 signals the solenoids 26 to close selected vacuum valves 24 and open selected vacuum valves 31. Preferably, at this point vacuum valves 24*a* and 24*b* are kept open, interconnecting enclosures 12*a* and 12*b*. The vacuum valve 24*c* corresponding to enclosure 12*c* is closed, valve 31*a* is closed, and valve 31*c* is opened, so that enclosure 12*c* acts as a receiver tank for gases pumped from 12*a* and 12*b*. The vacuum pump unit 20 then further evacuates enclosures 12*a* and 12*b* through the open vacuum valve 31*c* into the partially evacuated enclosure 12*c* acting as a receiver tank. The desired pressure to which enclosures 12*a* and 12*b* are evacuated is also a function of the characteristics of the vacuum pump 20 and the enclosures 12, and also is not crucial. Alternatively, enclosures 12*a* and 12*c* may be interconnected by opening valves 24*a* and 24*c*, or any other combination of enclosures 12 may be interconnected, so long as at least one enclosure 12 is available to act as a receiver tank.

When the desired pressure is achieved in the selected enclosures 12, as indicated by transducers 36, the process control device 34 signals the solenoids 26 to close vacuum valve 31*c* corresponding to enclosure 12*c* and vacuum valve 24*b* corresponding to enclosure 12*b*. Concurrently, vacuum valve 31*b* of enclosure 12*b* is opened and the vacuum valve 24*a* of enclosure 12*a* is kept open. With the valves in this configuration, the vacuum pump 20 further evacuates enclosure 12*a* into enclosure 12*b* through the open vacuum valve 31*b*.

When the desired pressure is achieved in enclosure 12*a*, the process control device 34 signals the solenoids 26 to close vacuum valve 31*b* and vacuum valve 24*a*. Concurrently, vacuum valve 24*c* of enclosure 12*c* is opened and the vacuum pump 20 evacuates enclosure 12*c* to the atmosphere. This cycle may be repeated until a sufficiently high degree of vacuum is achieved in enclosure 12*a*.

With the invention, the single-stage pump 20 can be operated always in an optimum range of pressure differentials across the pump. Thus, by partially evacuating the enclosures and then evacuating selected enclosures to other enclosures already evacuated, a very high vacuum can be achieved with small pressure differentials across the pump. It should also be understood that the precise vacuum level achieved is not critical to the present invention.

The present invention may be embodied in other specific forms without departing from the spirit or essential attributes thereof and, accordingly, reference should be made to the appended claims, rather than to the foregoing specification, as indicating the scope of the invention.

What is claimed is:

1. Method for producing a vacuum in a plurality of enclosures, comprising the steps of:

(a) partially evacuating all of the enclosures to the atmosphere;

(b) further evacuating solely to the remaining partially evacuated enclosures through a single stage pump connected between said selected enclosures and said remaining enclosures;

(c) evacuating said remaining enclosures to the atmosphere; and (d) repeating steps (b) and (c) until a desired degree of vacuum is achieved.

2. Method for producing a vacuum in a plurality of enclosures, comprising:

(a) providing a plurality of enclosures, a plurality of valve means separately interconnecting vacuum pump means and the plurality of enclosures, a plurality of conduit means for selectably connecting the vacuum pump exhaust and the plurality of enclosures, and control means operative to control the pump means and the valve means;

(b) closing said conduit means and opening selected ones of said valve means approximately simultaneously for a predetermined time sufficient for the vacuum pump means to partially evacuate the enclosures to the atmosphere;

(c) closing at least one of said valve means and opening at least one of said conduit means approximately simultaneously for a predetermined time sufficient for the vacuum pump means to partially evacuate at least one of the plurality of enclosures into at least one other enclosure acting as receiver enclosure;

(d) opening valve means corresponding to the receiver enclosures and closing the remaining valve means and conduit means approximately simultaneously for a predetermined time sufficient for the vacuum pump means to partially evacuate the receiver enclosures to atmosphere; and (e) repeating steps (b) through (d) until a desired degree of vacuum is achieved.

3. Apparatus for producing a high degree of vacuum utilizing only a single stage pump comprising:

(a) a means for evacuating a plurality of enclosures to the atmosphere;

(b) a single stage pump connected between selected first enclosures and second enclosures for evacuating said selected first enclosures solely to said second partially evacuated enclosures; and (c) a means for evacuating the second partially evacuated enclosures to the atmosphere while maintaining the air pressure in the selected first partially evacuated enclosures.

4. Apparatus for producing a vacuum in a plurality of enclosures comprising:

(a) a plurality of enclosures;

(b) a manifold means having a plurality of inlet means and a common outlet means, each inlet means being connected to one of the plurality of enclosures;

(c) vacuum pump means connected to the manifold outlet means for drawing a vacuum thereon;

(d) conduit means selectably connecting the exhaust of the vacuum pump means to at least one of the plurality of enclosures and to atmosphere; and (e) valve means in the inlet means and in the conduit means for selectably interconnecting the plurality of enclosures.

5. Apparatus as in claim 4, wherein the vacuum pump means is a single-stage pump.

6. Apparatus as in claim 4, wherein the valve means are butterfly valves.

7. Apparatus as in claim 4, wherein the first conduit means includes a butterfly valve, conduit means, and cooling means.

8. Apparatus as in claim 4, wherein the plurality of enclosures comprises three enclosures.

9. Apparatus as in claim 8, further comprising the conduit means separately connecting the vacuum pump means exhaust to two of said enclosures.

10. Apparatus as in claim 4, further comprising process control means operatively associated with the valve means, for controlling the state of the valve means, said process control means being responsive to input signals.

11. Apparatus as in claim 10, further comprising transducer means arranged to sense internal pressure of the enclosures and generate electrical signals representative of internal pressure, the electrical signals forming input signals to the process control means.

* * * * *